US008851902B2

(12) United States Patent
Shifris et al.

(10) Patent No.: US 8,851,902 B2
(45) Date of Patent: Oct. 7, 2014

(54) MODULAR CONNECTOR FOR A CABLE-LESS PATCHING DEVICE

(75) Inventors: Pinchas Shifris, Tel Aviv (IL); Alex Shar, Rishon Letzion (IL); Tzion Priav, Ramat Gan (IL)

(73) Assignee: RIT Technologies Ltd., Tel Aviv (IL)

( * ) Notice: Subject to any disclaimer, the term of this patent is extended or adjusted under 35 U.S.C. 154(b) by 136 days.

(21) Appl. No.: 13/520,832

(22) PCT Filed: Jan. 6, 2011

(86) PCT No.: PCT/IL2011/000014

§ 371 (c)(1), (2), (4) Date: Jul. 6, 2012

(87) PCT Pub. No.: WO2011/083470

PCT Pub. Date: Jul. 14, 2011

(65) Prior Publication Data

US 2013/0130516 A1 May 23, 2013

Related U.S. Application Data

(60) Provisional application No. 61/292,912, filed on Jan. 7, 2010.

(51) Int. Cl.

| | |
|---|---|
| ***H01R 12/00*** | (2006.01) |
| ***H01R 13/60*** | (2006.01) |
| ***H01R 24/00*** | (2011.01) |
| ***H01R 13/66*** | (2006.01) |
| ***H01R 13/703*** | (2006.01) |
| ***H01R 24/64*** | (2011.01) |
| ***H01R 31/06*** | (2006.01) |
| *H01R 12/71* | (2011.01) |

(52) U.S. Cl.

CPC ..... *H01R 13/60* (2013.01); *H01R 23/025* (2013.01); *H01R 12/716* (2013.01); *H01R 13/6658* (2013.01); *H01R 13/7033* (2013.01); *H01R 24/64* (2013.01); *H01R 31/06* (2013.01)

USPC ..... 439/65; 439/676

(58) Field of Classification Search

CPC .. H01R 23/025; H01R 23/005; H01R 31/065; H01R 23/722

USPC ..... 439/65, 502, 638, 676

See application file for complete search history.

(56) References Cited

U.S. PATENT DOCUMENTS

| | | | |
|---|---|---|---|
| 5,178,554 | A | 1/1993 | Siemon et al. |
| 6,012,936 | A | 1/2000 | Siemon et al. |
| 6,371,780 | B1 | 4/2002 | Aponte et al. |

(Continued)

FOREIGN PATENT DOCUMENTS

| | | |
|---|---|---|
| CN | 2582209 | 10/2003 |
| CN | 2687899 | 3/2005 |
| CN | 2831476 | 10/2006 |

OTHER PUBLICATIONS

International Search Report for International Application No. PCT/IL2011/000014 dated May 9, 2011.

*Primary Examiner* — Khiem Nguyen

(74) *Attorney, Agent, or Firm* — Pearl Cohen Zedek Latzer Baratz LLP

(57) ABSTRACT

Embodiments of the present invention are directed to a modular jack or modular connector mountable on a patch panel and having two openings. A first opening may receive a standard modular plug and a second opening may enable access to the resilient part of the conductive contacts inside the jack by a conductive element. The conductive element may electrically connect the connector to a second connector. The connector may be disconnected from the second connector when a communication plug is inserted into the first opening of the connector.

20 Claims, 5 Drawing Sheets

(56) References Cited

U.S. PATENT DOCUMENTS

| | | | |
|---|---|---|---|
| 6,599,152 | B1 | 7/2003 | Oliphant et al. |
| 6,612,856 | B1 | 9/2003 | McCormack |
| 6,644,995 | B1 | 11/2003 | Jones et al. |
| 2007/0293094 | A1 | 12/2007 | Aekins |
| 2008/0214058 | A1 | 9/2008 | Machado et al. |
| 2008/0233803 | A1 | 9/2008 | Renteria et al. |

MODULAR CONNECTOR FOR A CABLE-LESS PATCHING DEVICE

CROSS-REFERENCE TO RELATED APPLICATIONS

This application is a National Phase Application of PCT International Application No. PCT/IL2011/000014, International Filing Date Jan. 6, 2011, claiming priority of U.S. Patent Application No. 61/292,912, filed Jan. 7, 2010, the entire disclosure of which is incorporated herein by reference.

BACKGROUND OF THE INVENTION

Surface mounted connectors, such as jacks connectors are well known in the data communication field. Jacks connectors can be used as sockets for the frontal surface of patch panels, which are used in communication networks as intermediate elements between the endpoint devices such as network switches.

The network connectivity may be arranged in cross connect or interconnect configurations. In a cross connect network configuration, two patch panels are placed between the endpoint devices and the network switch where one patch panel represents ports of the switch and the other represents the endpoint and the two patch panels are connected by removable patch cords. In an interconnect network configuration only one patch panel is placed between the endpoint devices and the network switch.

Several solutions of cable-less patching devices have been presented, where pairs of jacks mounted on the same patch panel, one of the pair represent an end device and the other represent a port of the network switch are internally connected. These solutions are not suitable however for transferring high data rates.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features and advantages thereof, may best be understood by reference to the following detailed description when read with the accompanied drawings in which:

Figure 1:
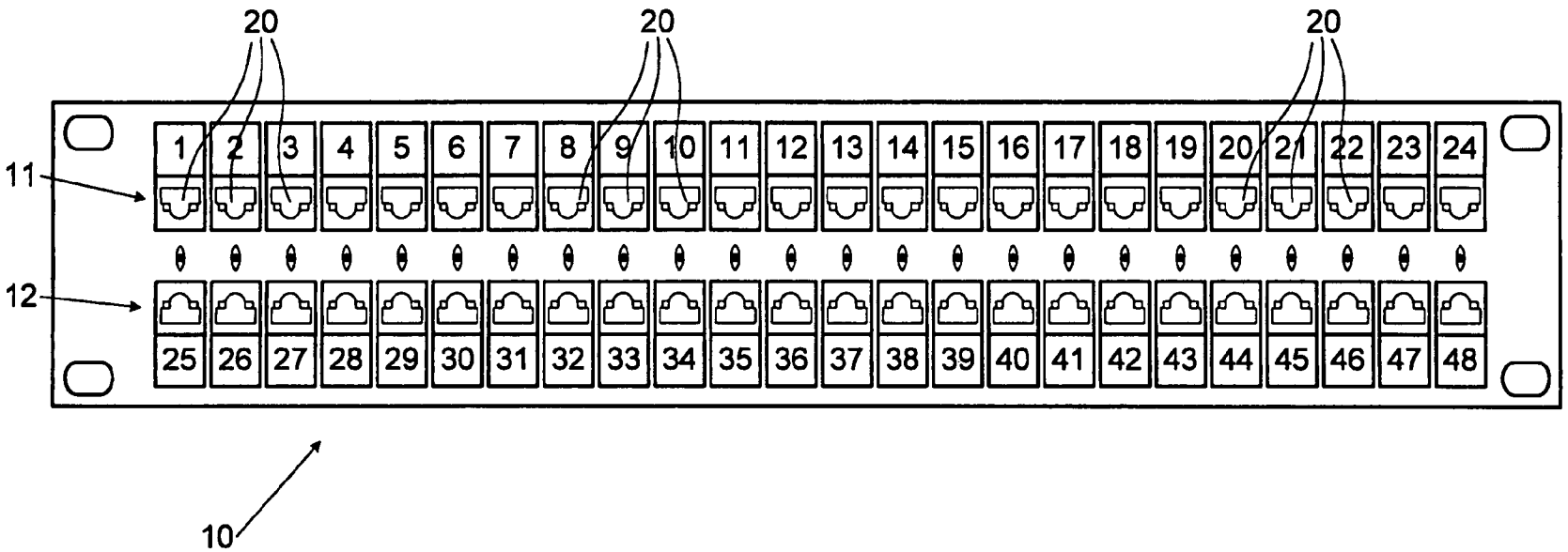
FIG. 1 is a front view of a double port patch panel according to embodiments of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF EMBODIMENTS OF THE INVENTION

In the following detailed description, numerous specific details are set forth in order to provide a thorough understanding of the invention. However it will be understood by those of ordinary skill in the art that the embodiments of present invention may be practiced without these specific details. In other instances, well-known methods, procedures and components have not been described in detail so as not to obscure the present invention.

Patch panel and network equipment rack systems may manage and organize cables to and from other network equipment and/or to and from other patch panels. Patch panel systems are generally intended to facilitate organization and management in implementing telecommunications wiring systems, e.g., for high speed data networks.

Embodiments of the present invention are directed to a dual-connector assembly having two connectors or modular jacks that are connected internally by a conductive element. The dual-connector unit is mountable directly on a motherboard of a patch panel. The motherboard as well as the internal connecting element may include a cross-talk compensating circuit or elements. Embodiments of the present invention are directed to a switchless patch panel having dual-connector units that eliminate the need of patch cord cabling. Yet, if desired, other conductive corrections between ports of the patch panels may be established using patch cords. The switchless patch panel is designed for use in communication networks that are designed for transferring data at high rates of about 500 MHz and above per a single twisted pair of wires. Such a connection between two connectors by a conductive element may create a cross connect communication system.

Reference is now made to FIG. 1, which is a front view of an exemplary double port patch panel according to embodiments of the present invention. A patch panel 10 may include a mother board (not shown) and a plurality of dual-connector units mountable on the mother board. The front end of patch panel 10 include an upper plurality of female modular conductive connectors (jacks) 20 arranged in an upper row 11 and a lower row 12 such that each jack within row 11 is a mirror image of a respective jack within lower row 12. Each dual-connector unit comprises a first jack on an upper row, a second jack on the lower row and an internal connecting conductive element (not shown) that electrically connect the pair of jacks. When a patch cord is plugged into jacks 20 positioned in the front side of patch panel 10 the internal connection is cut off and another connection not within the dual-connector unit may be established externally.

Each of jacks 20 may be typically terminated with a punch down type connector, such as IDC, positioned on the rear side of patch panel 10. An IDC allows for termination of individual conductor wires to a certain jack. Each conductor wire may be correctly positioned and terminated to the correct IDC on the correct jack by a human installer. The individual conductor wires may be connected to any desired termination. Wires or cables, e.g., unshielded twisted pair (UTP) cables coupled to endpoint devices may be connected for example to the insulation displacement connectors (IDC's), positioned at the rear side of patch panel 10 (not shown). Patch panel 10 may be one of a plurality of patch panels mounted on the same communication rack.

Although embodiments of the present invention are not limited in this respect, jacks 20 may be arranged in an upper row 11 and a lower row 12 positioned, such that the conductive contact jacks within row 11 are positioned in a mirror image relative to the contact jacks of lower row 12. Any other number of rows and any other structure of jacks, however, may be used. Moreover, embodiments of the invention may include a plurality of patch panels which may include one or more rows of jacks.

According to some embodiments of the invention, a first jack located at an upper row and a second jack located under the first jack at a lower row (for example, jack no. 1 and jack no. 25) may be internally electrically connected without using any cord or cable. The electrical connection between jack no. 1 and jack no. 25, located below jack 1, may be established by an electrical element such as an electrical board or circuit as described in detail herein.

The internal connection between pairs of jacks may provide cordless connections eliminating the use of patch cord cables to connect, for example, end users to network equipment. The assembly of the dual-connector unit includes two jacks and one conductive element with no external housing. Therefore, a number of N assemblies welded to a single motherboard may create a panel with 2*N jacks. In some embodiments, the connecting element may be a conductive electrical circuit on the motherboard of the patch panel itself. In other embodiments, the connecting elements may be a plurality of single elements. Such a patch panel may enable transfer of high data rates, e.g., higher than 500 MHz due to the fact that at least one of the motherboard and the internal connecting element may include embedded cross-talk compensation elements.

The exemplary patch panel 10 of FIG. 1 presents 24 assemblies of double connectors or double jacks according to embodiments of the present invention. In this exemplary illustration, jack no. 1 is connected to jack no. 25 as a first dual-connector, jack no. 2 is connected to jack no. 26 as a second dual-connector, jack no. 23 is connected to jack no. 47 as a twenty third dual-connector and jack no. 24 is connected to jack no. 48 as a twenty fourth dual-connector. Any other connection of jacks which are not located one under the other may be established by using an external patch cord inserted into the relevant jacks. For example, upon insertion of a first end of a patch cord to jack no. 20, jack no. 20 would be disconnected from jack no. 44. Upon insertion of the second end of the patch cord to jack no. 31, jack no. 31 would be disconnected from jack no. 7 and be connected to jack no. 20.

Although embodiments of the present invention are not limited in this respect, patch panel 10 and the connectors or jacks described herein may provide the basic characteristics of a structured cabling system according to international standards for structured cabling systems such as standards of the American National Standards Institute (ANSI), Telecommunications Industry Association (TIA), Electronic Industries Alliance (EIA) and International Organization for Standardization (ISO)/International Electrotechnical Commission (IEC). For example, TIA/EIA-568-C and ISO/IEC 11801.

Although embodiments of the present invention are not limited in this respect, the connectors described herein may include any type of connectors such as RJ45 at any performance levels such as, for example category 5, 5*e*, 6, 6A and higher, defined in these standards, copper connectors, fiber optics connectors, BNC connectors and others. The invention is not limited to such connectors, but is equally applicable to other known or subsequently developed connectors.

Figure 2A:
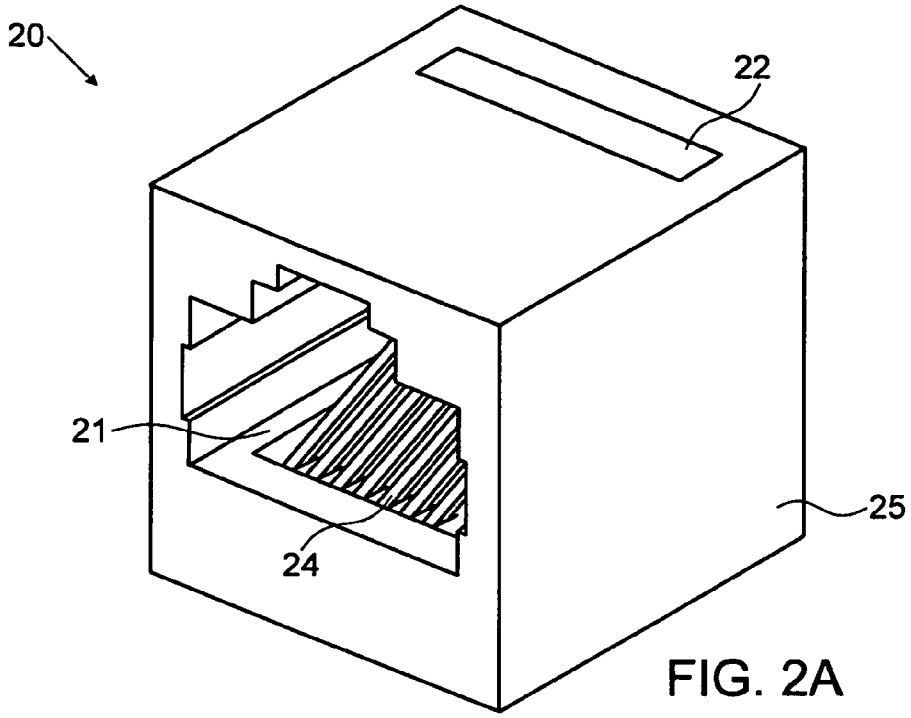
FIGS. 2A and 2B are perspective and cross sectional views of a connector according to embodiments of the present invention.
Figure 2B:
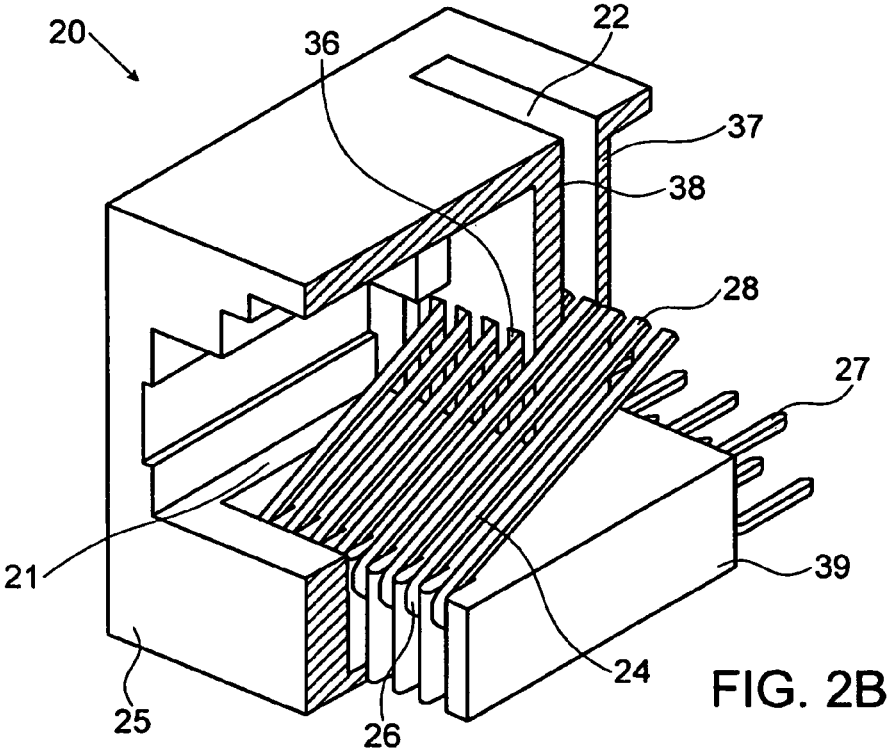

Reference is now made to FIGS. 2A and 2B. FIG. 2A is a perspective view of a connector according to embodiments of the present invention and FIG. 2B is a cross sectional view of a connector according to embodiments of the present invention. Connector 20 may include a housing 25 having a first opening or receiving cavity 21 and a second opening, slot or receiving cavity 22. The first receiving cavity 21 is to receive a communication plug, for example, a standard plug of a patch cord which may connect connector 20 to another connector and thereby connect between two communication ports. The second receiving cavity or slot 22 is to receive a conductive element or a connecting element (shown in FIG. 3) to electrically connect connector 20 to a second, substantially similar, connector. Slot 22 is located at the rear side of the connector's housing and it may be defined between an external rear wall 37 of housing 25 and an internal rear wall 38 of housing 25.

Connector 20 may include an array of elongated, electrical, resilient conductive contacts or pins 24 for receiving electrical signals. The resilient conductive pins or electrical contacts 24 may be parallel and may be closely spaced such as to fit to an array of electrical contacts of a plug inserted into receiving cavity 21. Each electrical contact of electrical contacts 24 may include a first end extending through housing 25 as pins 27, a bend or a curved shape at its middle 26 and a resilient end at its second end 25, the resilient end may be located at slot 22. Resilient conductive pins 24 may be bent such that the first end of the resilient conductive pins may extend through and beyond external rear wall 37 and the second end of the resilient conductive pins may be positioned within slot 22, between external rear wall 37 and internal rear wall 38 without extending beyond external rear wall 37. Connector 20 may further include a support element 39 that may hold bent resilient conductive pins 24 such that a first portion of the resilient conducting pins 24 may be positioned between a surface of the housing and a bottom surface of the support element and a second portion of the bent resilient conductive pins 24 may be positioned over a top surface of the support element and does not extend beyond the rear wall 37.

When a plug is inserted into receiving cavity 21 the resilient end 28 of resilient conductive pins 24 may be pushed down towards the bottom of connector 20 such as to allow an electrical contact. An electrical signal may progress from the electrical contacts of the inserted plug to electrical contacts 24 and from pins 27 to an external destination via, for example, an IDC block terminated on the rear side of a patch panel. (not shown)

According to embodiments of the invention, when no plug is inserted into receiving cavity 21, a conductive element inserted into slot 22 may be in direct access and contact with resilient end 28 of the plurality of conductive contacts 24 inside connector 20 such as to electrically connect modular connector 20 to a substantially similar, modular connector.

Figure 3:
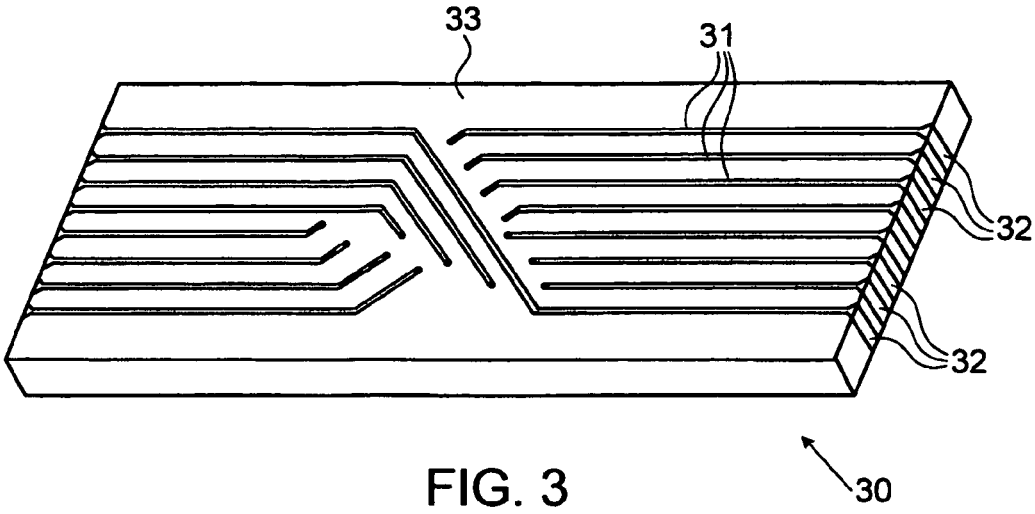
FIG. 3 is a perspective view of a conductive electrical circuit according to embodiments of the present invention.

Reference is now made to FIG. 3, which is a perspective view of a conductive electric circuit according to embodiments of the present invention. A conductive electric circuit or a conductive connecting element 30 may be used to electrically connect between two modular connectors or modular jacks such as connector 20 of FIG. 2A. Although embodiments of the present invention are not limited in this respect, conductive electric circuit 30 may include conductive pathways, tracks or signal traces 31 along its non-conductive body 33 and conductive contacts 32 at both top and bottom (not shown) ends of circuit 30. The number of conductive contacts 32 may be identical to the number of conductive contacts 24 inside connector 20 or may fit in any other way to conductive contacts 24 as to allow an electrical connection.

Internal rear wall 38 may include a plurality of openings 36, e.g., the same number as the number of conductive pins 24, to allow the resilient conductive pins 24 to pass through or slide down through internal rear wall 38 while moving away from connecting element 30 when a plug is inserted into receiving cavity 21.

Conductive connecting element 30 may be a printed circuit board (PCB), however any other electric circuit in any form or shape that may fit into the second opening 22 of connector 20 as to enable electrical connection between two connectors as described in the present invention may be used. Non-conductive body 33 may be formed of any suitable material, such as plastic or other suitable non-conductive material. Conductive signal traces 31 and conductive contacts 32 may be formed of a suitable material, such as metal. However, any suitable conductive material may be used.

Figure 4A:
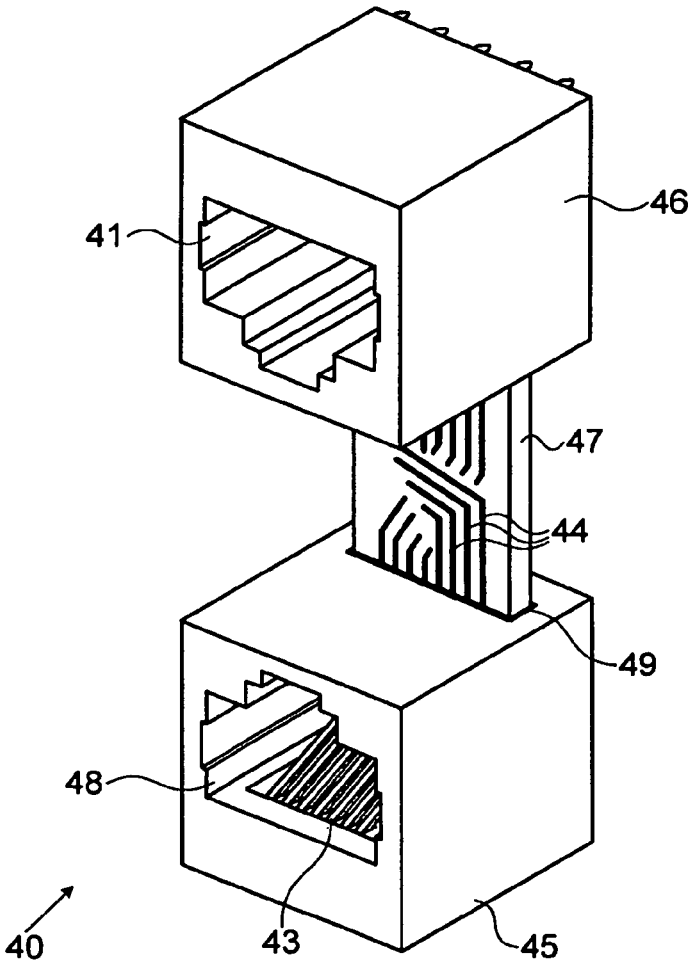
FIGS. 4A and 4B are a perspective view and a cross sectional view of a dual connector assembly according to embodiments of the present invention.
Figure 4B:
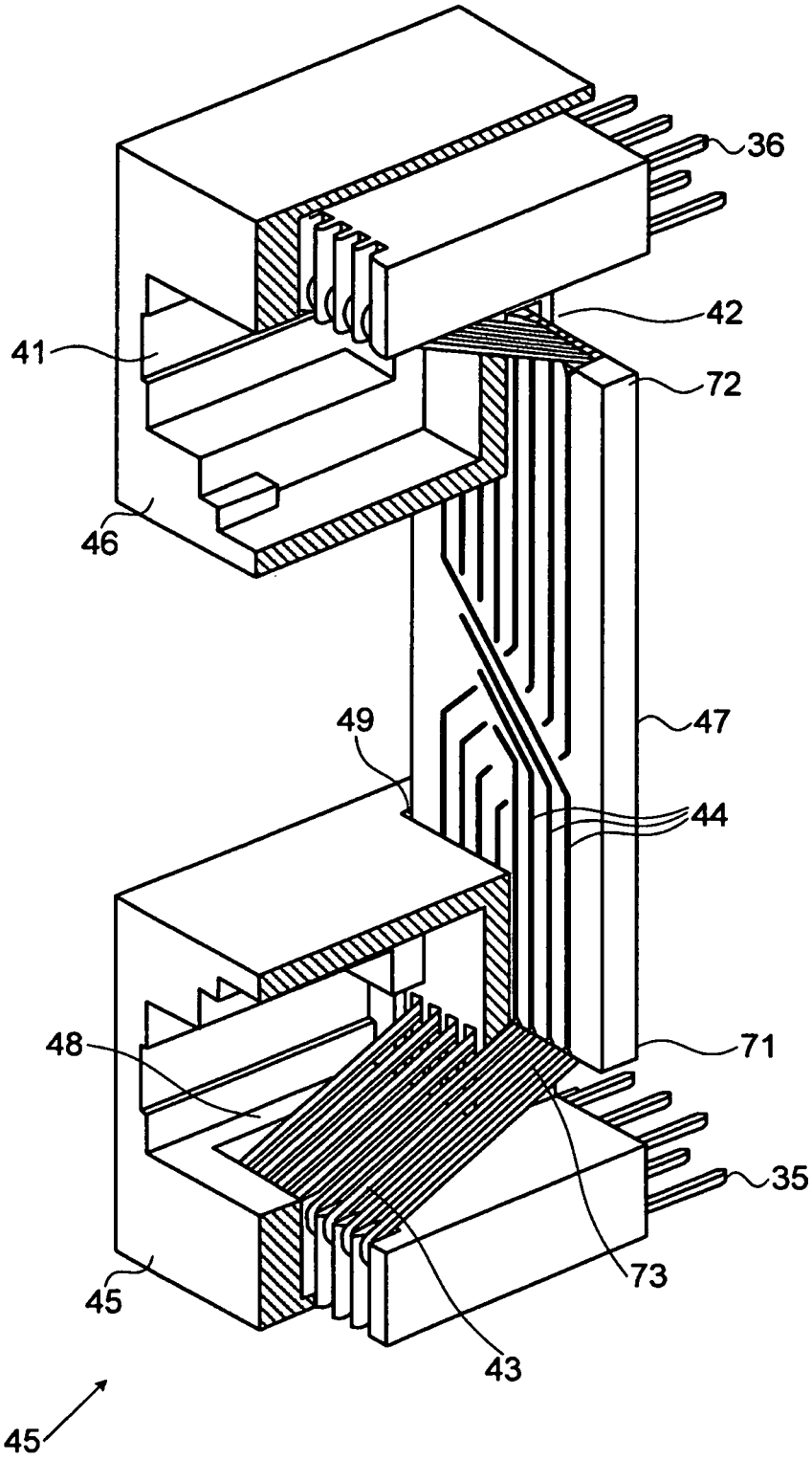

Connecting element 30 may include one or more cross-talk compensation elements which may be embedded into, mounted on or fixed to connecting element 30 in any method or technique in order to reduce or eliminate cross talk effects Reference is now made to FIGS. 4A and 4B. FIG. 4A is a perspective view of a dual connector assembly according to embodiments of the present invention and FIG. 4B is a cross sectional view of a dual connector assembly according to embodiments of the present invention. According to embodiments of the present invention a dual connector assembly 40 may include a first connector 45, a second connector 46 and a conductive element 47 to electrically connect the first connector to the second connector when inserted into a dedicated opening at both connectors as described herein. Connector 46 and connector 45 may be identical modular connectors and while being connected by conductive element 47, they may be organized in top-to-top arrangement, namely the upper part of connector 45 is directed to the upper part of connector 46 as shown in FIG. 4A. Connector 45 may include a first opening 48 to receive a communication plug and a second opening 49 to receive a first end 71 of conductive element 47. Connector 46 may include a first opening 41 to receive a communication plug and a second opening 42 to receive a second end 72 of conductive element 47.

According to embodiments of the present invention, when conductive element 47 is inserted into two opposing modular jacks or connectors, namely, to both second opening 49 of connector 45 and second opening 42 of connector 46, an electrical contact may be made between the resilient ends 73 of the electrical contacts 43 and traces 44 of conductive element 47 via contacts at the top and bottom of conductive element 47 (contacts 32 shown in FIG. 3). As a result an electrical connectivity may be made between pins 36 of connector 46 and pins 35 of connector 45 as to allow a high data transfer rate between connectors 45 and connector 46.

According to embodiments of the present invention, a connection between connector 45 and connector 46 by conductive element 47 may allow a switch-less or a cable-less connection, namely, a connection made without any external wire or cable inserted in the standard openings of the connectors. Such a cable-less connection may enable transfer of a high data rates due to the fact that both conductive element 47 and the motherboard which connectors 45 and 46 are mounted to, for example, the patch panel (not shown) may have compensation elements.

Figure 5A:
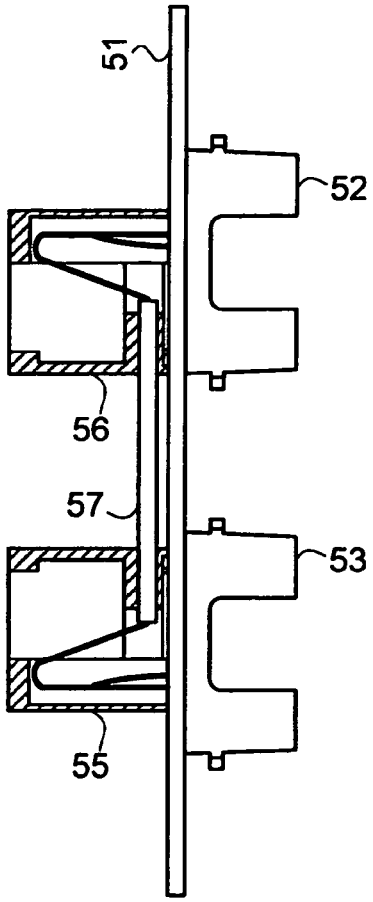
FIGS. 5A and 5B are cross sectional side views of a dual connector assembly according to embodiments of the present invention.
Figure 5B:
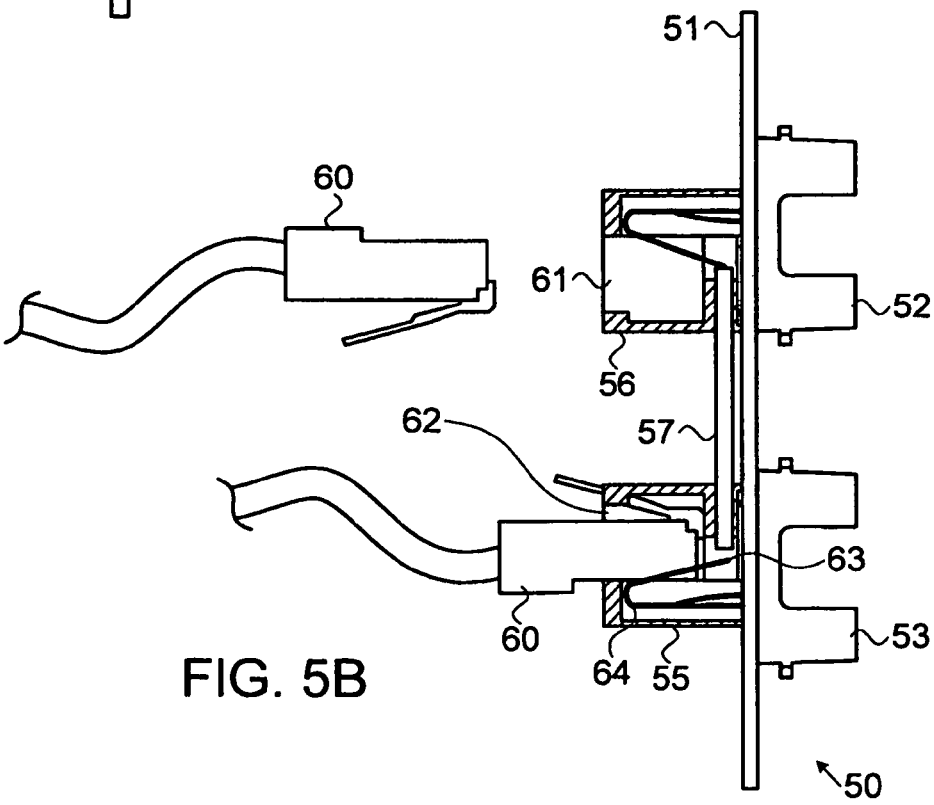

Reference is now made to FIGS. 5A and 5B which are cross sectional side views of a dual connector assembly according to embodiments of the present invention. FIG. 5A is a cross sectional side view of a dual connector assembly 50 which may be connected or attached to motherboard 51 and termination blocks 52 and 53. Although the present invention is not limited in this respect, motherboard 51 may be a patch panel motherboard, for example, path panel 10 of FIG. 1. Dual connector assembly 50 may include a first modular jack or connector 55, a second modular jack or connector 56 and a conductive element 57.

According to embodiments of the invention, when no plug is inserted into jack 55 or jack 56, termination blocks 52 and 53 may be electrically connected via conductive traces of conductive element 57. For example, a RJ45 connector may be plugged into termination block 53 and may be routed to a communication switch, while a horizontal cable may be connected to termination block 52 and routed to a personal computer. According to this example, when no plug is inserted into dual connector assembly 50, the personal computer may be constantly connected to the switch without the use of any additional cord or cable to connect between connectors 55 and 56.

FIG. 5B is a cross sectional side view of a dual connector assembly 50 and a plug 60. Plug 60 may be inserted into the receiving opening 61 of connector 56 or into the receiving opening 62 of connector 55. According to embodiments of the invention, when no plug is inserted into connectors 55 and 56, an electrical connection may exist between termination block 52 and termination block 53 via connector 55, conductive element 57 and connector 56. When plug 60 is inserted into a receiving opening of a connector, for example, receiving openings 62, the resilient part 63 of electrical contacts 64 may move away from conductive element 57 and the electrical connection between connector 55 and connector 56 may be disconnected. When plug 60 is inserted into receiving openings 62 the resilient part 63 of electrical contacts 64 may move away from the electrical contacts on the bottom (or upper) side of the conductive element (Shown as contacts 32 in FIG. 3) as to eliminate the electrical connection between conductive element 57 and connector 55. When a plug is inserted to receiving cavity 21, the resilient conductive pins 24 are bend such that the second end of the resilient conductive pins 28 may move away from connecting element 57 by moving along the plurality of openings of the internal rear wall of the housing (openings 36 of FIG. 2B).

Embodiments of the invention may allow a standard use of connectors 55 and 56 if a plug is inserted into at least one of them, as a plug insertion may disable the electrical connection between connectors 55 and 56 via conductive element 57. However, if no plug is inserted into connector 55 and no plug is inserted into connector 56, conductive element 57 may connect connector 55 and connector 56 such as to enable an electrical connection between termination block 52 and termination block 53 without any use of a cable, cord or external connection between connector 55 and connector 56.

In the exemplary illustration of FIGS. 1-5, certain connectors are illustrated, however, it should be understood to a person skilled in the art that any desired form, shape or appearance of a connector may be applicable.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A dual-connector unit comprising:

two jack connectors and an electrically connecting element having electrical contacts at both ends and configured to electrically connect the two jack connectors, wherein each jack connector comprises:

a housing having a receiving cavity to receive a communication plug and a slot to receive the electrically connecting element, wherein the slot is defined between an external rear wall of the housing and an internal rear wall of the housing; and resilient conductive pins bent such that a first end of the resilient conductive pins extends through and beyond the external rear wall of the housing and a second end of the resilient conductive pins is positioned in the slot between the external rear wall of the housing and the internal rear wall of the housing;

wherein the connecting element is inserted into both slots of the two connectors so that the resilient conductive pins of each connector are electrically connected to respective contacts of the connecting element to provide an internal electrical connection between the two jack connectors and when the communication plug is inserted to the receiving cavity of either one of the connectors, the respective resilient conductive pins are moved away from the respective contacts of the connecting element so as to disconnect the electrical connection of the two jack connectors.

2. The dual-connector unit of claim 1, wherein dual-connector unit is mountable on a motherboard of a patch panel.

3. The dual-connector unit of claim 1, wherein the connecting element is a conductive circuit board.

4. The dual-connector unit of claim 1, wherein the connecting element comprises a compensation element.

5. The dual-connector unit of claim 1, wherein the two connectors are organized in top-to-top arrangement.

6. The dual-connector unit of claim 1, wherein the communication plug is a standard communication plug.

7. The dual-connector unit of claim 1, wherein the internal rear wall of the housing comprises a plurality of openings to allow the resilient conductive pins to pass through the internal rear wall of the housing while moving away from the connecting element when the communication plug is inserted to the receiving cavity.

8. The dual-connector unit of claim 1, wherein the connecting element is in contact with the second end of the resilient conductive pins when inserted into the slot of each connector.

9. The dual-connector unit of claim 7, wherein when a plug is inserted to the receiving cavity, the resilient conductive pins are bend such that the second end of the resilient conductive pins is moved away from the connecting element by moving along the plurality of openings of the internal rear wall of the housing.

10. The dual-connector unit of claim 1, wherein the second end of the resilient conductive pins does not extend through the external wall of the housing when the communication plug is inserted to the receiving cavity.

11. A patch panel comprising:

a motherboard; and a plurality of dual-connector units positioned on the motherboard, each of the dual connector units comprising a first jack connector coupled to an end device and a second jack connector coupled to a network switch and an electrically connecting element having electrical contacts at both ends and configured to internally electrically connect the first and second jack connectors, wherein each of the first and second connectors comprises:

a housing having a receiving cavity to receive a communication plug and a slot to receive the electrically connecting element, wherein the slot is defined between an external rear wall of the housing and an internal rear wall of the housing; and resilient conductive pins bent such that a first end of the resilient conductive pins extends through and beyond the external rear wall of the housing and a second end of the resilient conductive pins is positioned in the slot between the external rear wall of the housing and the internal rear wall of the housing;

wherein the connecting element is inserted into both slots of the two connectors so that the resilient conductive pins of each connector are electrically connected to respective contacts of the connecting element to provide an internal electrical connection between the first and second jack connectors and when the communication plug is inserted to the receiving cavity of either one of the first or second connectors, the respective resilient conductive pins are moved away from the respective contacts of the connecting element so as to disconnect the electrical connection of the first and second jack connectors.

12. The patch panel of claim 11, wherein the first connector and the second connector of each dual-connector unit are organized in a top-to-top arrangement on the patch panel.

13. The patch panel of claim 11, wherein the plurality of dual-connector units eliminating the use of external cords connecting between pairs of first and second connectors.

14. The patch panel of claim 11, wherein the motherboard comprises a compensation element.

15. The patch panel of claim 11, wherein the connecting element is a conductive circuit board.

16. The patch panel of claim 11, wherein the connecting element comprises a compensation element.

17. The patch panel of claim 11, wherein the internal rear wall of the housing comprises a plurality of openings to allow the resilient conductive pins to pass through the internal rear wall of the housing while moving away from the connecting element when the communication plug is inserted to the receiving cavity.

18. The patch panel of claim 11, wherein the second end of the resilient conductive pins does not extend through the external wall of the housing when the communication plug is inserted to the receiving cavity.

19. A jack connector mountable on a patch panel comprising:

a housing having a receiving cavity to receive a communication plug and a slot to receive a connecting element that provides an internal electrical connection between the jack connector and a second jack connector mounted on the patch panel, wherein the slot is defined between an external rear wall of the housing and an internal rear wall of the housing; and resilient conductive pins bent such that a first end of the resilient conductive pins extends through and beyond the external rear wall of the housing and a second end of the resilient conductive pins is positioned in the slot between the external rear wall of the housing and the internal rear wall of the housing, wherein the jack connector is configured such that when mounted on the patch panel and the connecting element is inserted into the slot of the jack connector at one end and to a slot of the jack second connector at another end, the resilient conductive pins of the connectors are electrically connected to contacts of the connecting element to enable internal electrical connection between the jack connector and the second jack connector and when the communication plug is inserted to the receiving cavity, the resilient conductive pins are moved away from the connecting element so as to disable the internal electrical connection.

20. The connector of claim 19, wherein the connecting element comprises a compensation element.

* * * * *